US008438864B2

(12) United States Patent
Roetker et al.

(10) Patent No.: US 8,438,864 B2
(45) Date of Patent: May 14, 2013

(54) TRANSCRITICAL HEAT PUMP WATER HEATER AND METHOD OF OPERATION

(75) Inventors: John Joseph Roetker, Louisville, KY (US); Jonathan Charles Crosby, Louisville, KY (US)

(73) Assignee: General Electric Company, Schenectady, NY (US)

( * ) Notice: Subject to any disclaimer, the term of this patent is extended or adjusted under 35 U.S.C. 154(b) by 121 days.

(21) Appl. No.: 13/040,460

(22) Filed: Mar. 4, 2011

(65) Prior Publication Data

US 2012/0060521 A1 Mar. 15, 2012

(51) Int. Cl.

| | |
|---|---|
| ***F25B 7/00*** | (2006.01) |
| ***F25B 27/00*** | (2006.01) |
| ***F25B 13/00*** | (2006.01) |
| ***F28F 13/00*** | (2006.01) |
| ***F28F 3/12*** | (2006.01) |

(52) U.S. Cl.
USPC ..... 62/79; 62/238.6; 62/238.7; 62/324.3; 165/146; 165/147; 165/169

(58) Field of Classification Search ..... 62/79, 238.6, 62/238.7, 324.3; 165/146, 147, 149
See application file for complete search history.

(56) References Cited

U.S. PATENT DOCUMENTS

| | | | | |
|---|---|---|---|---|
| 2,575,325 | A * | 11/1951 | Ambrose et al. | 62/181 |
| 3,213,850 | A | 10/1965 | Heeger | |
| 4,257,355 | A | 3/1981 | Cook | |
| 4,556,104 | A * | 12/1985 | Engelhardt | 165/145 |
| 4,658,803 | A | 4/1987 | Ball et al. | |
| 5,946,927 | A * | 9/1999 | Dieckmann et al. | 62/238.6 |
| 7,210,303 | B2 * | 5/2007 | Zhang et al. | 62/183 |
| 7,310,960 | B2 | 12/2007 | Sienel et al. | |
| 2006/0191276 | A1 * | 8/2006 | Sienel et al. | 62/238.6 |
| 2010/0209084 | A1 * | 8/2010 | Nelson et al. | 392/465 |

* cited by examiner

*Primary Examiner* — Frantz Jules
*Assistant Examiner* — Erik Mendoza-Wilkenfel
(74) *Attorney, Agent, or Firm* — Dority & Manning, P.A.

(57) ABSTRACT

A method for increasing efficiency of a transcritical heat pump water heater system is provided, as well as the corresponding system. The refrigerant, such as CO2, is compressed to a supercritical point and passed through a gas cooler that is wrapped at least partially around a water storage tank, wherein the refrigerant transfers heat to water stored in the tank. The hot water is discharged from the storage tank proximate to a top of the tank, and cold water is introduced into the tank proximate to a bottom of the tank. The supercritical refrigerant is directed to flow through the gas cooler from a top point to a lowermost point in a flow direction such that the refrigerant exits the gas cooler proximate to the bottom of the tank at a location of the coldest water within the storage tank.

5 Claims, 3 Drawing Sheets

TRANSCRITICAL HEAT PUMP WATER HEATER AND METHOD OF OPERATION

FIELD OF THE INVENTION

The present subject matter relates generally to water heaters, and more particularly to a heat pump water heater.

BACKGROUND OF THE INVENTION

Heat pump water heaters are gaining broader acceptance as a more economic and ecologically-friendly alternative to electric water heaters. These systems utilize a condenser configured in a heat exchange relationship with the water storage tank, for example wrapped around the tank in a series of coils. During operation of the vapor compression heat pump cycle, a refrigerant exits an evaporator as a superheated vapor and/or high quality vapor mixture. Upon exiting the evaporator, the refrigerant enters a compressor where the pressure and temperature increase and the refrigerant becomes a superheated vapor. The superheated vapor from the compressor enters the condenser, wherein the superheated vapor transfers energy to the water within a storage tank and returns to a saturated liquid and/or high quality liquid vapor mixture. Conventional refrigerants are able to reject heat to the water in the storage tank via condensation in the condenser.

Carbon dioxide (CO2) has emerged as a natural, ecologically friendly replacement for CFC and HCFC refrigerants. CO2, however, has a low critical point and thus operates on a transcritical cycle wherein it evaporates in the subcritical region and rejects (transfers) heat at temperatures above the critical point in a gas cooler instead of a condenser. U.S. Pat. No. 7,210,303 describes a transcritical heat pump water heater system.

An impediment to wide scale acceptance of transcritical heat pump systems, including water heater systems, is the perceived lower efficiency of the transcritical CO2 vapor compression cycle as compared to the CFC and HCFC systems. In this regard, improvements are constantly being pursued to increase the thermodynamic efficiency and coefficient of performance (COP) of the transcritical systems. The present invention relates to such improvements.

BRIEF DESCRIPTION OF THE INVENTION

Aspects and advantages of the invention will be set forth in part in the following description, or may be obvious from the description, or may be learned through practice of the invention.

In a particular embodiment of the invention, a method is provided for increasing efficiency of a transcritical heat pump water heater system. The method involves compressing a refrigerant, such as CO2, to a supercritical point and passing the refrigerant through a gas cooler that is wrapped at least partially around a water storage tank, wherein the refrigerant transfers heat to water stored in the tank. The hot water is discharged from the storage tank from a location proximate to a top of the tank, and cold water is introduced into the storage tank at a location proximate to a bottom of the tank. The refrigerant is directed to flow through the gas cooler from a top point to a lowermost point in a flow direction such that the refrigerant exits the gas cooler proximate to the bottom of the tank at a location of the coldest water within the storage tank. This method utilizes the temperature gradient of the water in the tank to maximize the temperature loss of the refrigerant as it circulates through the gas cooler, thereby increasing the thermodynamic efficiency of the heat pump cycle.

In a particular embodiment, the gas cooler is configured as a coiled heat exchanger wrapped in a series of coils around at least a portion of the storage tank. It is desirable in particular embodiments to maintain a stratified layer of relatively cold water proximate to the bottom of the tank where the refrigerant exit is located for enhanced cooling of the refrigerant. One means for achieving this is to concentrate the coils of the gas cooler closer to the top portion of the tank (above a mid level point). For example, the top portion may have a greater coil density as compared to the bottom portion of the tank, with the goal being to have high heat transfer above the low coil density portion to allow cooling of the coils at the bottom of the tank. In this configuration, the gas cooler transfers most of its heat to the water in the top portion of the tank and a well defined layer of relatively cold water is established in the bottom portion of the tank. In a further embodiment, it may be desired to define a section of the tank below the mid level point that is essentially void of coils of the gas cooler. A high density section of coils of may be provided below the void section of the tank proximate to the refrigerant exit so that the refrigerant is cooled even further prior to exiting the gas cooler.

The thermodynamically efficient method embodiments may result in hot water being generated at a temperature that is above a desired level. It this regard, it may be desired to mix cold water (e.g. with a controllable mixing valve) with the hot water discharged from the storage tank to reduce the temperature of the downstream hot water.

To take even further advantage of the incoming cold water, in a particular embodiment, the cold water is introduced into the storage tank at a cold water inlet that is proximate to the bottom of the tank. In other words, the cold water is not preheated by the hot water in the storage tank (as with a conventional dip tube design in an electric water heater system).

The present invention also encompasses any manner of a transcritical heat pump water heater system having the gas cooler and storage tank configuration as discussed above.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
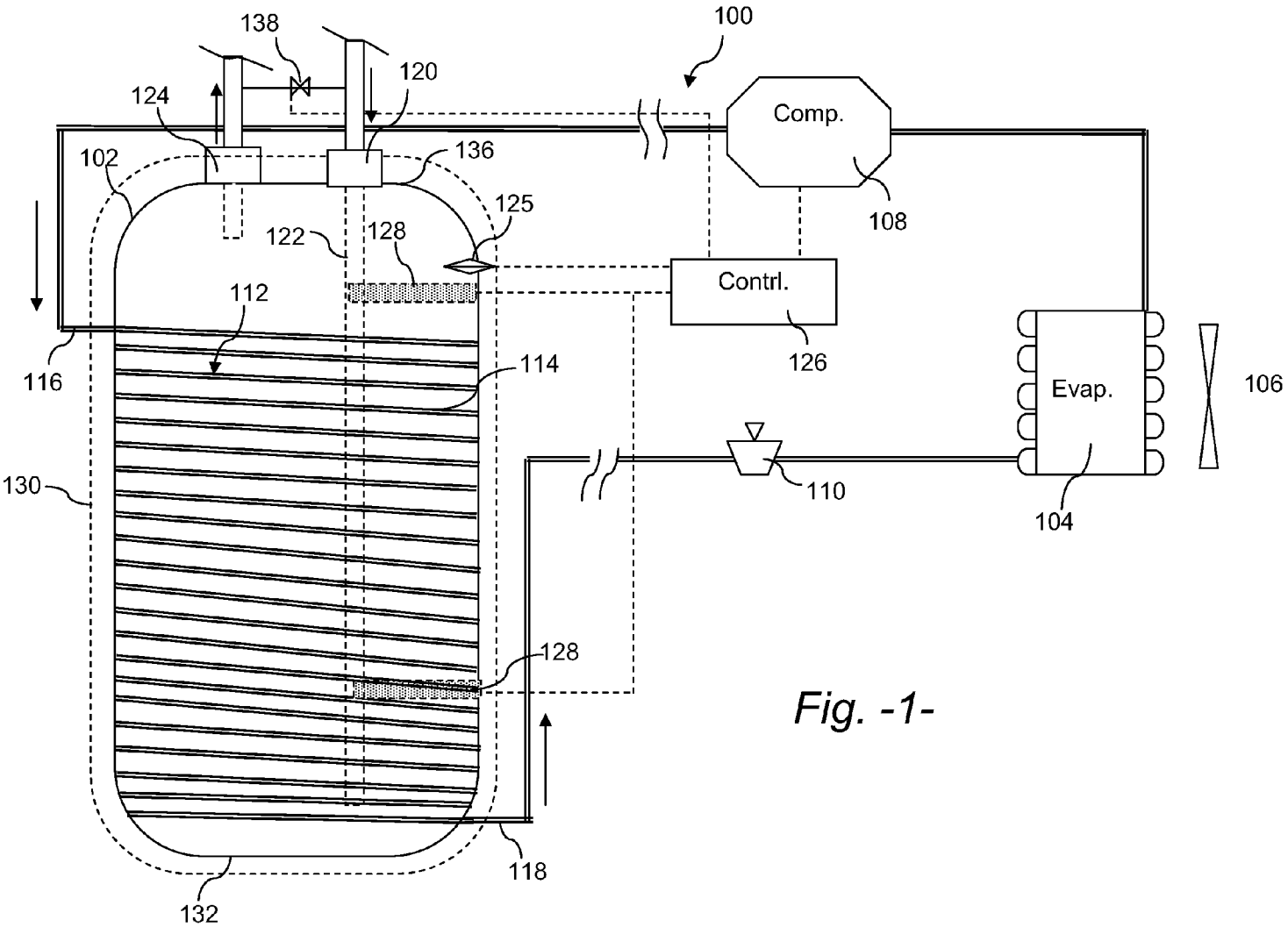
FIG. 1 is a diagram view of a heat pump water heater system in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts a transcritical heat pump water heater (HPWH) system 100 that incorporates aspects of the invention, as well as components of conventional HPWH systems. For example, the system 100 includes an evaporator 104 and associated fan 106, a compressor 108, a throttling or expansion device 110, and a gas cooler 112. The gas cooler 112 is assembled in a heat exchange relationship with a water storage tank 102 to heat the water within the tank. During operation of the heat pump cycle, a refrigerant, for example CO2, exits the evaporator 104 as a superheated gas and enters the compressor 108 wherein the pressure and temperature of the refrigerant are increased such that the refrigerant becomes a supercritical gas. The supercritical refrigerant from the compressor 108 enters the gas cooler 112 wherein it transfers energy to the water within the storage tank 102. The gas refrigerant exits the gas cooler 112 and travels through the expansion device 110, wherein the pressure and temperature of the refrigerant drop. The gas refrigerant then enters the evaporator 104 and the cycle repeats itself. Aspects of the gas cooler 112 will be described in greater detail below.

Figure 3:
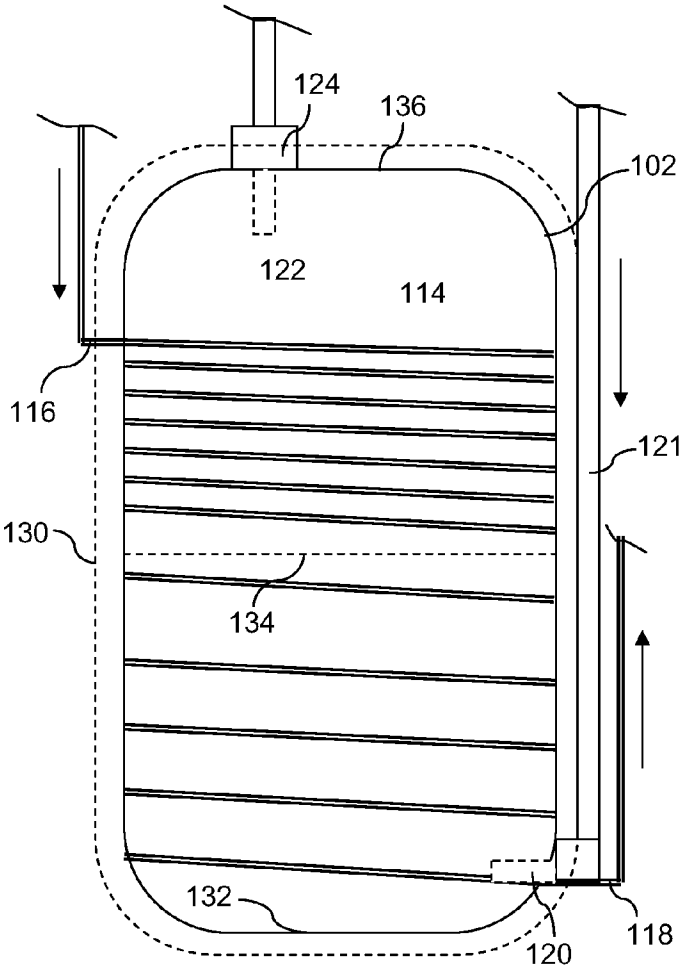
FIG. 3 is a view of an alternative embodiment of a heat pump water storage tank in accordance with aspects of the invention.

The water storage tank 102 in the system 100 of FIG. 1 may be a conventional water storage tank and includes a cold water inlet 120 for directing cold water to the bottom of the tank 102 via a dip tube 122 such that the water is preheated by the water in the tank before it discharges into the tank at the outlet of the dip tube 122. The tank 102 has a top 136, bottom 132, and a mid level point (height-wise) 134 (FIG. 3). The tank 102 may be surrounded by a shell component 130. Any manner of suitable thermal insulating material may be disposed within the space between the shell 130 and tank 102, as is well known in the art.

The system 100 may also include supplemental electric heating elements 128 placed near the top and bottom of the water storage tank 102 to heat the water. In general, the heating elements 128 are activated in situations wherein the demand for hot water placed on the system 100 exceeds the heating capability of the heat pump system.

The heated water exits the tank 102 at a hot water exit 124 and flows to the consumer's residential plumbing, or other location where the system 100 is installed. The system 100 may include a temperature sensor 125 positioned to sense the temperature of the water in the upper region of the tank and may also have additional temperature sensors placed at various locations for sensing other temperatures, such as heat pump condenser inlet and outlet temperatures, ambient temperature, etc.

The system 100 may also include a controller 126, equipped with a microprocessor, that determines which of the compressor 130 and/or electric resistance heating elements 128 shall be energized, and for how long, in order to heat the water within the water storage tank 102 to a setpoint temperature. The controller 1126 may receive any manner of temperature readings (e.g., from sensor 125), flow signals, setpoint, and so forth, to implement its control functions.

The gas cooler 122 is configured in a heat exchange relationship with at least a portion of the tank 102, depending on the particular configuration of the gas cooler 122. For example, the gas cooler 122 may be a planar or plate-like heat exchanger that is wrapped at least partially around the tank 102. In the illustrated embodiment, the gas cooler 122 is a coiled loop heat exchanger having a plurality of tube coils 114 wrapped around at least a portion of the tank 102. These coils may be disposed between the shell 130 and the tank 102, as depicted in the figures.

As a aspect of the invention, it has been determined that the thermodynamic efficiency of the transcritical HPWH system 100 is quite sensitive to the temperature of the CO2 refrigerant that exits the gas cooler 112, and that further reduction of the temperature of the refrigerant prior to the expansion device 110 and evaporator 104 can lead to a meaningful increase in the overall efficiency of the system. In this regard, the system 100 is uniquely configured so that the specific heat of the refrigerant, at an appropriate operating pressure and tank temperature, coincides with the location of the upper coils. The refrigerant is directed to flow through the gas cooler 112 from a top point at a refrigerant inlet 116 to a lowermost point at a refrigerant exit 118 in a flow direction such that the refrigerant exits the gas cooler 112 proximate to the tank bottom 132, which generally corresponds to the location of the coldest water within the storage tank 102. This configuration utilizes the temperature gradient of the water in the tank 102 to maximize the temperature loss of the refrigerant as it circulates through the gas cooler 112.

Figure 4:
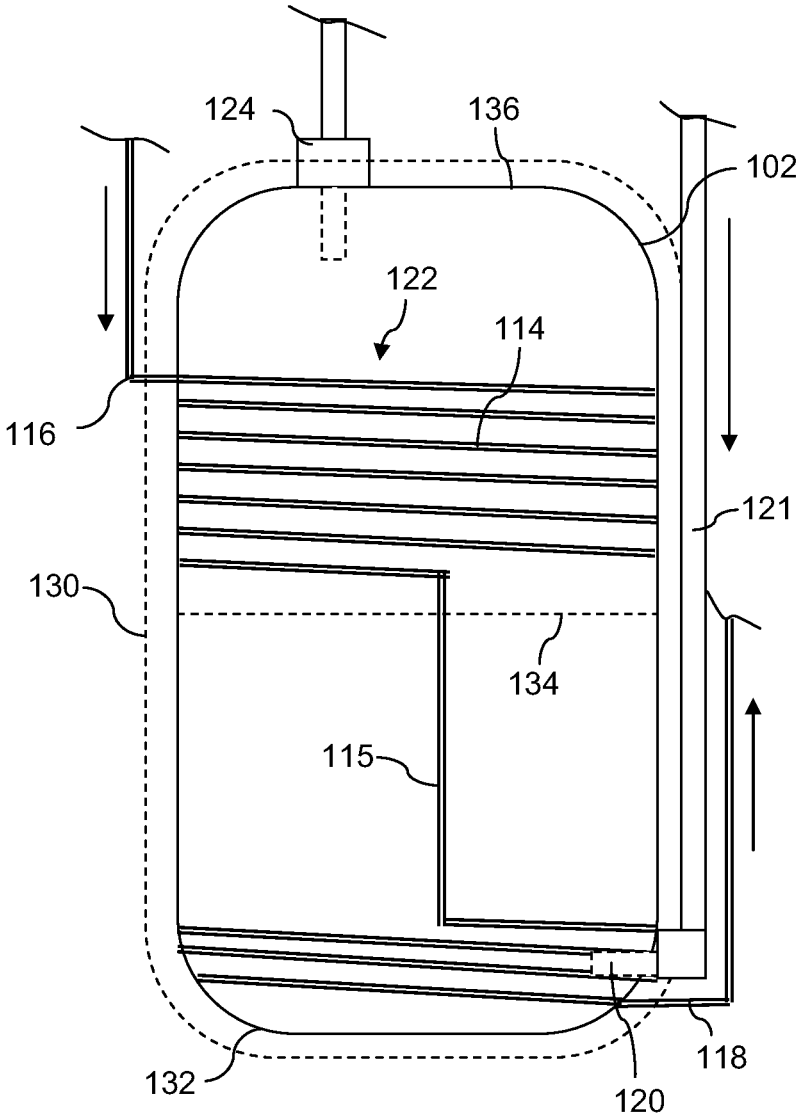
FIG. 4 is a view of yet another embodiment of a heat pump water heater storage tank in accordance with aspects of the invention.

The coils 114 of the gas cooler 114 are wrapped around at least a portion of the storage tank 102 to transfer heat to the water while utilizing the temperature gradient of the water in the tank to maximize the temperature drop (glide) of the refrigerant. Thus, it may be desirable in particular embodiments to maintain a stratified layer of relatively cold water at the tank bottom 132 proximate to the refrigerant exit 118. Referring to FIGS. 3 and 4, one means for achieving this is to concentrate the coils 114 in the top portion of the tank (e.g., above a mid level point 134 or other defined boundary). For example, referring to FIG. 3, the top portion of the gas cooler 122 has a higher density of coils 114 above a void or lower coil density section, followed by a high density coil section proximate to the bottom portion of the tank 102. In this configuration, the gas cooler 112 transfers most of its heat to the water in the top portion of the tank 102 and a well defined layer of relatively cold water is established and maintained in the bottom portion of the tank 102 for final, lower cooling of the refrigerant.

FIG. 4 depicts another embodiment wherein the coils 114 are concentrated in the top portion of the tank 102. In this embodiment, a section of the tank 102 below the mid level point 134 is essentially void of coils 114. A straight cooler section 115 connects the coils 114 in the top portion of the tank 102 with a smaller, high density section of coils 114 in the bottom portion of the tank proximate to the refrigerant exit 118. These bottom coils 114 serve to drop the refrigerant temperature while also causing some degree of initial heating of the cold water introduced into the tank.

Figure 2:
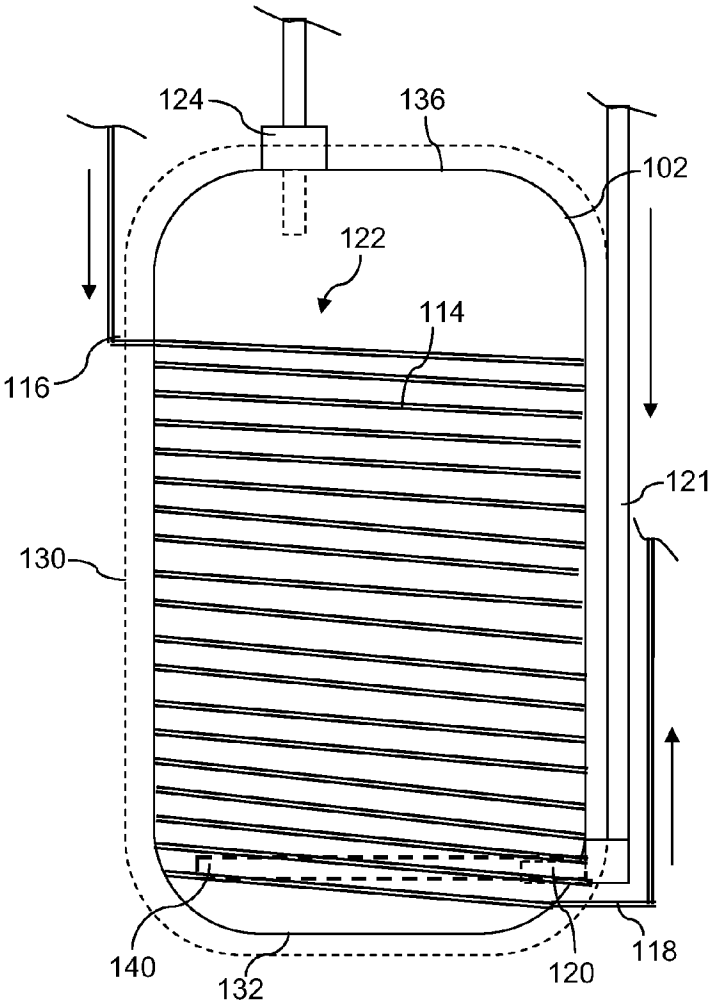
FIG. 2 is a view of an embodiment of a heat pump water storage tank in accordance with aspects of the invention.

To take even further advantage of the incoming cold water, in particular embodiments as depicted in FIGS. 2 through 4, the cold water is introduced into the storage tank 102 at a cold water inlet 120 that is proximate to the tank bottom 132 and is not preheated by the hot water in the storage tank 102 (as with the dip tube 122 design of FIG. 1). The cold water inlet 120 may be supplied with cold water via an inlet supply pipe 121 that is disposed alongside of the tank 102. It should be appreciated, however, that any manner of suitable piping arrangement may be utilized to conduct cold water into the tank at a location of the cold water inlet 120 generally proximate to the tank bottom 132.

Referring to FIG. 2, this embodiment includes a discharge pipe 140 connected to the cold water inlet 120. This discharge pipe 140 includes any configuration of outlets that serve to uniformly distribute the cold water introduced into the tank 102 across the diameter of the tank. The outlets may be disposed so as to direct the cold water towards the bottom 132 of the tank so as to enhance thermal stratification within the tank.

It is possible that, in certain embodiments, the system 100 may generate hot water that exceeds a desired temperature. In this situation, it may be desired to mix cold water with a controllable mixing valve 138 (FIG. 1) with the hot water discharged from the storage tank 102 to reduce the temperature of the downstream hot water. The mixing valve 138 may be operated by the controller 126 as a function of sensed water temperature within the tank 102 via temperature sensor 125.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for increasing efficiency of a transcritical heat pump water heater system, comprising;

compressing a transcritical refrigerant to a supercritical point and passing the refrigerant through a gas cooler that is wrapped at least partially around a water storage tank, wherein the refrigerant transfers heat to water stored in the tank;

discharging hot water from the storage tank proximate to a top of the tank, and introducing cold water into the tank proximate to a bottom of the tank;

wherein the refrigerant is directed to flow through the gas cooler from a top point to a lowermost point in a flow direction such that the refrigerant exits the gas cooler proximate to the bottom of the tank at a location of the coldest water within the storage tank;

wrapping the gas cooler as a continuous member in a series of coils around and in contact with the storage tank;

stratifying a pronounced temperature gradient of the water within the storage tank to maintain a relatively cold water layer proximate the bottom of the tank by wrapping a greater number of coils around the top portion as compared to bottom portion of the tank proximate to the refrigerant exit;

wherein the top portion of the tank above a mid-level point has a high density section of coils of the gas cooler as compared to the bottom portion of the tank;

defining a section of the tank below the high density section of coils in the top portion of the tank that is essentially void of coils of the gas cooler; and providing an additional section of coils of the continuous member below the void section of the tank proximate to the refrigerant exit.

2. The method as in claim 1, further comprising mixing cold water with the hot water discharged from the tank to reduce the temperature of the hot water supplied from the storage tank via a discharge line to a downstream location.

3. The method as in claim 1, further comprising introducing the cold water into the storage tank at a cold water inlet that is proximate to the bottom of the tank so as not to preheat the cold water with hot water in the storage tank.

4. A transcritical heat pump water heater system, comprising:

a water storage tank;

a sealed heat pump cycle, comprising a compressor, a gas cooler, an evaporator, and a transcritical refrigerant, wherein said gas cooler is disposed in a heat exchange relationship with at least a portion of said storage tank for heating water within said tank;

said tank further comprising a hot water outlet proximate to a top of said storage tank through which hot water is discharged, and a cold water inlet proximate to a bottom of said storage tank to introduce cold water into said storage tank;

wherein said gas cooler comprises a refrigerant entry proximate to said top of said storage tank and a refrigerant exit proximate to said bottom of said storage tank such that said refrigerant exits said gas cooler proximate to said bottom of said storage tank at a location of the coldest water within said storage tank;

wherein said gas cooler comprises a continuous member wrapped in a series of coils around and in contact with said storage tank;

wherein a greater number of said coils are disposed around a top portion above a mid-level point of said storage tank as compared to a bottom portion of said storage tank;

said top portion of the said storage tank above a mid-level point having a high density section of said coils as compared to said bottom portion of said storage tank;

a section of said storage tank below said high density section of coils in said top portion of said storage being essentially void of said coils; and an additional section of said coils of said continuous member gas cooler coil wrapped around said storage tank below said void section proximate to the refrigerant exit.

5. The heat pump water heater system as in claim 4, wherein said cold water inlet is external to said tank proximate to said bottom of said tank.

* * * * *